United States Patent [19]

Olashaw

[11] 4,181,396

[45] Jan. 1, 1980

[54] ALUMINUM-COPPER ELECTRICAL JOINT

[75] Inventor: William F. Olashaw, Plainville, Conn.

[73] Assignee: General Electric Company, New York, N.Y.

[21] Appl. No.: 939,535

[22] Filed: Sep. 5, 1978

[51] Int. Cl.[2] ..... H01R 7/08

[52] U.S. Cl. ..... 339/263 R; 339/278 C; 403/287; 403/390

[58] Field of Search ..... 339/263 R, 263 L, 278 R, 339/278 C; 174/84 S, 88 B, 94 S; 403/287, 390, 404

[56] References Cited

U.S. PATENT DOCUMENTS 2,904,620 9/1959 Eichelberger et al. ..... 174/88 B

FOREIGN PATENT DOCUMENTS 2414822 10/1975 Fed. Rep. of Germany ..... 339/263 R

*Primary Examiner*—Joseph H. McGlynn

*Attorney, Agent, or Firm*—Robert A. Cahill; Walter C. Bernkopf; Philip L. Schlamp

[57] ABSTRACT

An aluminum insert, friction welded to a copper plate, is projected through a close-fitting aperture in an aluminum busbar and joined to the busbar by a circumferential weld at the exit end of the aperture, using conventional arc welding techniques, to complete a high ampacity, aluminum-copper electrical joint. The copper plate is then bolted to a copper strap in conventional high ampacity, bolted electrical joint fashion.

10 Claims, 4 Drawing Figures

ALUMINUM-COPPER ELECTRICAL JOINT

BACKGROUND OF THE INVENTION

The present invention relates to electrical joints of high current carrying capacity, i.e., ampacity, and particularly to an aluminum-copper electrical joint.

With the rapidly inflating price of copper, electrical switchboard and panelboard manufacturers are going more and more to using aluminum buswork. When making electrical joints with aluminum busbars, it is desirable to avoid using bolted joints as much as possible, due to the tendency of aluminum to gradually cold flow away from the bolt clamping pressure. This phenomenon produces, in time, a relaxation in the joint pressure and a consequent degradation of the joint integrity. Thus welded joints are preferable when making electrical joints between, for example, two aluminum busbars. Conventional arc welding techniques are quite suitable in joining two aluminum parts. There are however many situations in switchboard and panelboard assembly requiring electrical joints between aluminum and copper current carrying parts. Again, bolted joints clamping aluminum and copper parts in electrical contacting engagement are preferably avoided, if possible. Arc welding of aluminum and copper parts does not achieve satisfactory results. Impact welding has been used to butt weld aluminum and copper busbars together in achieving a high ampacity welded electrical joint. Unfortunately, impact welding requires massive equipment and thus unlike arc welding, cannot be performed at the site of switchboard assembly. Friction welding of aluminum and copper parts has met with considerable success. Basically, this welding technique involves bringing the two parts together under pressure while one part is held stationary and the other part is rotated at high velocity. In the case of an aluminum to copper friction welds, the stationary part is preferably the copper part and the aluminum part is the rotated one. Friction welding, to my knowledge, has not been utilized for aluminum-copper electrical joints in switchboard and panelboard manufacture, again due to the inability to weld at the site of switchboard assembly and the practical limitation as to the configuration of the rotated aluminum part, i.e., a cylinder.

Since electrical equipment installed in switchboards and panelboards are typically terminated with current carrying parts of copper, bolted electrical joints connecting the equipment into the buswork cannot be avoided. To avoid the potential problems associated with the juxtaposition of two dissimilar metals in an aluminum-copper bolted joint and to preclude oxide formation on the aluminum joint contacting surface, prefabricated copper-clad aluminum busbars and connectors have been resorted to. The copper cladding can then be used as the bolted joint interface with copper current carrying parts, and the aluminum base can be readily butt welded to other aluminum current carrying parts using conventional arc welding equipment. It will be appreciated that copper-clad aluminum busbars and connectors, while less expensive than their copper counterparts, are more costly than such parts formed wholly of aluminum.

It is accordingly an object of the present invention to provide an improved high ampacity aluminum-copper electrical joint.

An additional object is to provide an aluminum-copper electrical joint of the above character having particular application in switchboard and panelboard assembly.

A further object is to provide an aluminum-copper joint of the above character which can be conveniently perfected at the site of switchboard and panelboard assembly.

Yet another object is to provide an aluminum-copper joint of the above character which includes an aluminum-aluminum welded joint interface, an aluminum-copper welded joint interface and a copper-copper bolted joint interface.

A still further object is to provide an aluminum-copper joint of the above character wherein the aluminum-copper welded joint interface is provided in a prefabricated connector member.

Another object of the present invention is to provide an aluminum-copper electrical joint of the above character which is of high integrity, long lasting, inexpensive, and convenient to implement.

Other objects of the invention will in part be obvious and in part appear hereinafter.

SUMMARY OF THE INVENTION

In accordance with the present invention, there is provided an aluminum-copper electrical joint having particular application to switchboards and panelboards utilizing aluminum buswork. The principal component of this joint is a prefabricated connector consisting of an aluminum insert friction welded to a copper plate. To facilitate friction welding, the aluminum insert is in the form of a solid cylindrical block. An aluminum busbar to which the connector is to be applied is provided with a close-fitting aperture through which the aluminum insert is projected. The exit end of the aperture is chamfered to provide an annular groove between the aluminum busbar and the free end of the aluminum insert. Using conventional arc welding techniques, a weld fillet is laid in this groove to create a high ampacity, aluminum-aluminum electrical joint. The connector copper plate is provided with one or more holes for accommodating bolts used in perfecting a bolted electrical joint between this strap and another copper current carrying part.

The invention accordingly comprises the features of construction and arrangement of parts which will be exemplified in the construction hereinafter set forth, and the scope of the invention will be indicated in the claims.

For a better understanding of the nature and objects of the invention, reference should be had to the following detailed description taken in conjunction with the accompanying drawings, in which.

Like reference numerals refer to corresponding parts throughout the several views of the drawings.

DETAILED DESCRIPTION

Figure 1:
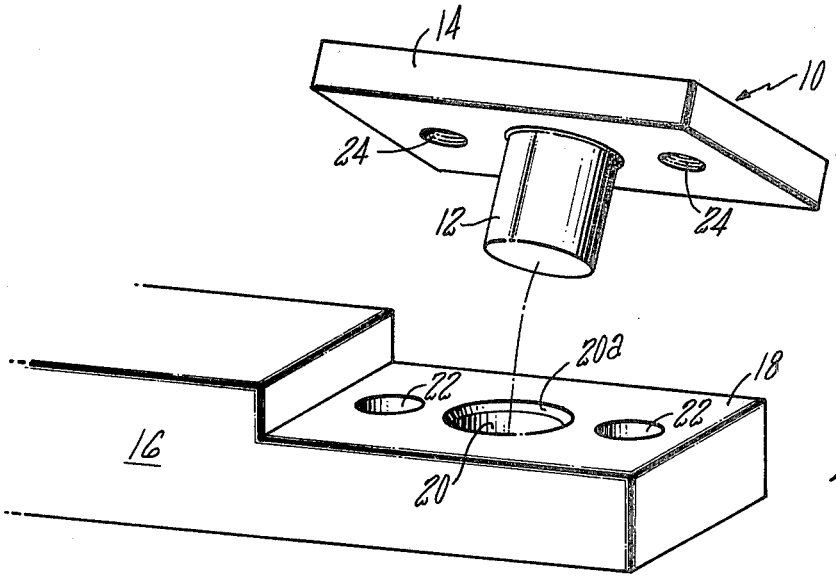
FIG. 1 is a perspective view of an aluminum-copper joint connector and a portion of an aluminum busbar suitably machined to accept the connector pursuant to making an aluminum-copper electrical joint in accordance with one embodiment of the present invention.

Referring to FIG. 1, an aluminum-copper electrical joint in accordance with one embodiment of the invention utilizes a prefabricated connector, generally indicated at 10, comprising an aluminum insert 12, illustrated in the form of a solid cylindrical block, which is welded to a rectangular plate 14 formed of copper. While there are several commercially available techniques for welding aluminum and copper together to form a high ampacity electrical joint of lasting integrity, I prefer to utilize friction welding. Pursuant to this welding technique, plate 14 is held stationary and insert 12, while being rotated at a high velocity, is pressed against the strap to achieve an extremely strong, reliable welded joint. Since insert 12 is being rotated, its illustrated cylindrical configuration is preferred. Although friction welding equipment can handle rotated parts of regular polygon cross-section, the difficulty of predicting the angular relationship of the rotated part of the stationary part upon completion of the weld militates against utilizing aluminum inserts 12 having cross-sections other than circular. Thus, it will be appreciated that the inset 12 could have a frusto-conical configuration.

Figure 2:
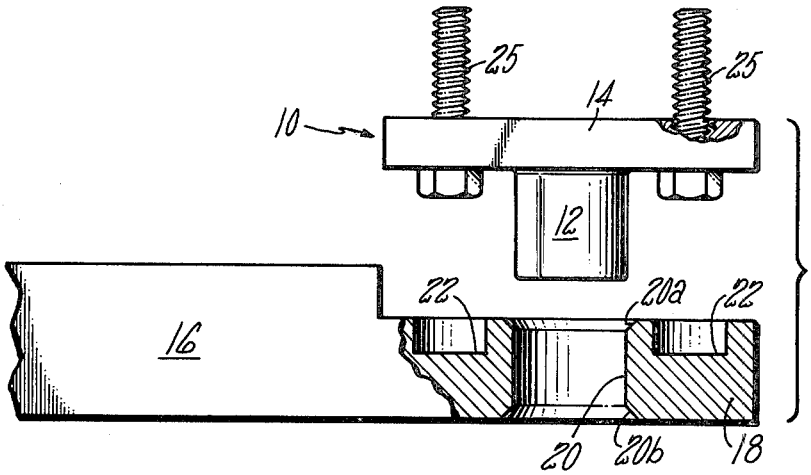
FIG. 2 is a side elevational view, partially in section, of the machined aluminum busbar portion and joint connector of FIG. 1, with the addition of joint clamping bolts to the connector.
Figure 3:
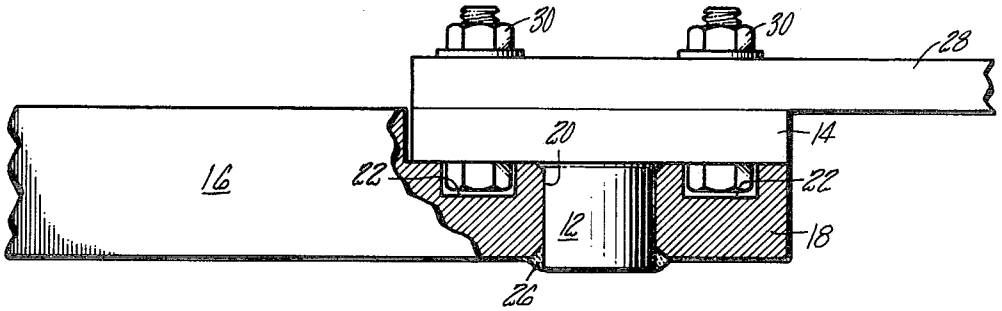
FIG. 3 is a side elevational view, partially in section, of a completed aluminum-copper electrical joint utilizing the parts seen in FIGS. 1 and 2.

To accept connector 10, an aluminum busbar 16 is milled down to provide a termination section 18 of reduced thickness. A hole 20 is drilled through this busbar termination section, the diameter of which being slightly greater than the diameter of insert 12. A pair of recesses in the form of blind holes 22 are drilled in termination section 18 in straddling relation to hole 20. A pair of tapped holes 24 are formed in plate 14 in straddling relation with insert 12. As seen in FIG. 2, bolts 26 are threaded tight through these tapped holes and then staked to secure them in place. As seen in FIGS. 2 and 3, to assemble connector 10 to busbar termination section 18, insert 12 is inserted through hole 20, while blind holes 22 accommodate the heads of bolts 25. Preferably, the entrance end of hole 20 is chamfered, as indicated at **20*a* in FIG. 2, to afford clearance for the slight material offset about the junction of insert 12 with plate 14 occasioned by the friction welding process. In addition, the exit end of hole 20 is also chamfered, as indicated at 20*b*, to create an annular groove surrounding the leading or free end portion of insert 12 which projects somewhat beyond the lower surface of the busbar termination section. An arc welder is then utilized to lay a weld fillet 26 (FIG. 3) in this annular groove and thus create an aluminum-aluminum welded electrical joint for conducting current between busbar 16 and insert 12. To complete the electrical joint embodiment of the invention, seen in FIG. 3, a copper strap 28, suitably apertured to accept the shanks of rigidly held bolts 24, is tightly clamped in electrically contacting engagement with copper plate 14 via nuts 30** torqued down onto the bolt shanks. It is important to note that the clamping pressure of this bolted joint is not exerted through any portion of the aluminum busbar termination section.

From the foregoing description of the embodiment of the invention seen in FIGS. 1 through 3, current is conducted between aluminum busbar 16 and strap 28 via a succession of three high ampacity electrical joints of lasting integrity; namely, the aluminum-aluminum joint between busbar termination section 18 and insert 12 provided by the arc weld fillet 26, the aluminum-copper friction weld between the insert and plate 14, and finally the copper-copper bolted joint between the plate and the strap.

Figure 4:
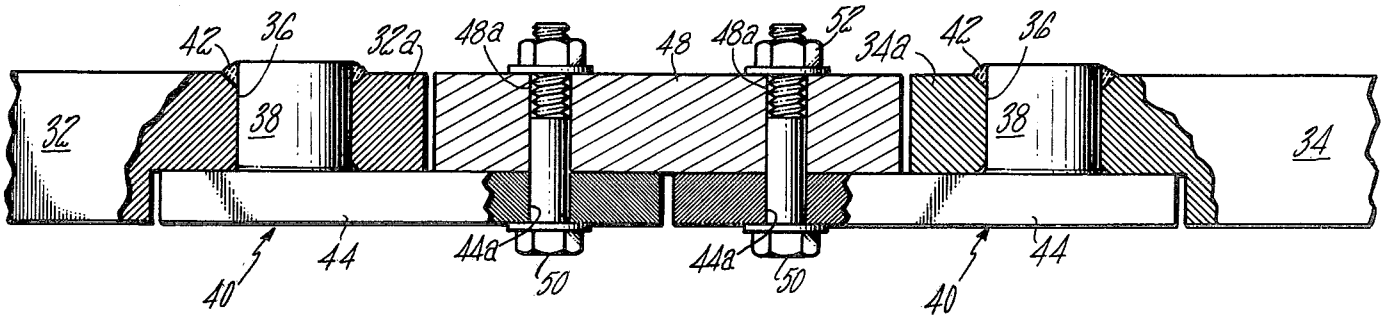
FIG. 4 is a side elevational view, partially in section, of an aluminum-copper, copper-aluminum electrical joint constructed in accordance with an alternative embodiment of the invention.

FIG. 4 illustrates a modification of the invention having particular application to joining at the site of installation aluminum busbar segments of adjacent switchboard vertical sections into complete horizontal bus runs. Busbar 32 represents an aluminum horizontal bus segment of one switchboard vertical section, while busbar 34 is the corresponding horizontal bus segment of an adjacent switchboard vertical segment assembled separately as so-called "shipping splits" to facilitate shipment to the site of switchboard installation. The ends of these busbars are milled to reduce thickness termination sections **32*a* and 34*a* respectively. A hole 36 is drilled through each termination section to accept a cylindrical aluminum insert 38 of separate prefabricated connectors, generally indicated at 40. The inserts are arc welded to their respective busbar terminal sections 32*a*, 34*a*, as indicated at 42, to create aluminum-aluminum welded electrical joints therebetween. The insert 38 of each connector 40 is friction welded to a separate copper plate 44. The portion of the plate of each connector extending beyond the end of its associated busbar 32, 34, is provided with one or more bolt holes 44*a*. The two switchboard vertical sections are then shipped to the site of installation and set up with their associated horizontal bus segments 32, 34 in alignment. Then to complete a horizontal bus run, a copper splice plate 48, supplied by the manufacturer, is positioned in lapping relation with the copper plates 44 of the two connectors 40. Bolts 50 are then inserted through the bolt holes 44*a* in the plates 44 and mutually aligned bolt holes 48*a* in the splice plate. Nuts 52 are then torqued down on these bolts to complete bolted electrical joints between the splice plate and the plates of the two connectors 40**. Again, it is to be noted that joint clamping pressures are exerted exclusively through copper parts.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sence.

Having described my invention, what I claim as new and desire to secure by Letters Patent is:

1. A high ampacity alumimum-copper electrical joint comprising, in combination:

A. an electrical connector including
   (1) a copper plate and
   (2) an aluminum insert of circular cross-section welded at one end to said plate;

B. an aluminum current carrying member including means forming a through hole therein through which said insert is inserted in close-fitting relation;

C. a circumferential weld electrically interconnecting the free, other end of said insert to said aluminum current carrying member at the exit end of said through hole;

D. a copper current carrying part;

E. means forming at least one pair of aligned bolt holes exclusively in said copper plate and said copper part, and F. a bolt extending through said pair of bolt holes and a nut threaded on said bolt to exert clamping pressure exclusively on said copper plate and copper part pursuant to perfecting a bolted electrical joint therebetween.

2. The electrical joint defined in claim 1, wherein said aluminum current carrying member is chamfered at the exit end of said through hole to provide an annular groove in which the periphery of said insert adjacent its free end is exposed, said circumferential weld being in the form of a weld fillet created in said annular groove by an arc welding process.

3. The electrical joint defined in claim 2, wherein said insert is welded to said plate using a friction welding process.

4. The electrical joint defined in claim 1, wherein said aluminum current carrying member further includes means forming therein a surface recess in contiguous relation with the entrance end of said through hole for accommodating the head of said bolt as situated on the same side of said plate as said insert.

5. The electrical joint defined in claim 4, wherein said bolt hole in said copper plate is tapped and said bolt is threaded substantially as far as possible through said tapped through hole and then staked prior to the insertion of said insert through said hole in said aluminum current carrying member.

6. The electrical joint defined in claim 5, wherein said aluminum current carrying member is chamfered at the exit end of said through hole to provide an annular groove in which the periphery of said insert adjacent its free end is exposed, said circumferential weld being in the form of a weld fillet created in said annular groove by an arc welding process.

7. The electrical joint defined in claim 6, wherein said insert is welded to said plate using a friction welding process.

8. The electrical joint defined in claim 3, which includes a pair of aluminum current carrying members in the form of busbars having butt ends situated in spaced relation and a separate connector for each said busbar having its insert welded thereto at the exit end of said through hole therein and its plate extending beyond the butt end thereof, and said copper current carrying part being in the form of a splice plate having a separate bolt hole aligned with said bolt hole in each said connector plate, bolts extending through said aligned bolt holes and nuts threaded on said bolts pursuant to perfecting bolted joints between said connector plates and said splice plate.

9. The electrical joint defined in claim 8, wherein each said busbar is chamfered at the exit end of said through hole therein to provide an annular groove in which the periphery of said connector insert projecting therethrough is exposed, said circumferential weld being in the form of a weld fillet created in said annular groove by an arc welding process.

10. The electrical joint defined in claim 9, wherein said insert of each said connector is welded to its associated plate using a friction welding process.

* * * * *